US005081499A

United States Patent [19]

Nakao et al.

[11] Patent Number: 5,081,499

[45] Date of Patent: Jan. 14, 1992

[54] LIQUID DEVELOPING METHOD AND APPARATUS FOR ELECTROPHOTOGRAPHY, AND ELECTRODES THEREFOR

[75] Inventors: Sho Nakao; Chikashi Ohishi; Chiaki Kawamoto; Takao Nakayama; Hidefumi Sera, all of Shizuoka, Japan

[73] Assignee: Fuji Photo Film Co., Ltd., Kanagawa, Japan

[21] Appl. No.: 337,224

[22] Filed: Apr. 12, 1989

[30] Foreign Application Priority Data

| | | | |
|---|---|---|---|
| Apr. 12, 1988 | [JP] | Japan | 63-48920[U] |
| Apr. 12, 1988 | [JP] | Japan | 63-48921[U] |
| Apr. 12, 1988 | [JP] | Japan | 63-89373 |
| Apr. 14, 1988 | [JP] | Japan | 63-50035[U] |
| Apr. 14, 1988 | [JP] | Japan | 63-50037[U] |
| May 12, 1988 | [JP] | Japan | 63-62293[U] |
| May 12, 1988 | [JP] | Japan | 63-115239 |
| Jun. 14, 1988 | [JP] | Japan | 63-78436[U] |

[51] Int. Cl.[5] ..... G03G 15/10

[52] U.S. Cl. ..... 355/256; 355/261; 118/659; 118/647; 430/103

[58] Field of Search ..... 355/256, 261-265; 118/647-651, 659-662; 430/103, 49, 69

[56] References Cited

U.S. PATENT DOCUMENTS

| | | | |
|---|---|---|---|
| 3,635,195 | 1/1972 | Levy | 118/661 X |
| 3,886,900 | 6/1975 | Deshayes et al. | 118/651 |
| 3,929,099 | 12/1975 | Szymber et al. | 118/650 |
| 3,955,976 | 5/1976 | Honjo et al. | 430/103 |
| 4,266,869 | 5/1981 | Kuehnle et al. | 355/256 X |
| 4,555,461 | 11/1985 | Shiba et al. | 430/49 |
| 4,664,502 | 5/1987 | Fukushima et al. | 118/660 X |
| 4,702,980 | 10/1987 | Matsuura et al. | 430/69 X |

*Primary Examiner*—Joan H. Pendegrass
*Attorney, Agent, or Firm*—Sughrue, Mion, Zinn, Macpeak & Seas

[57] ABSTRACT

A liquid electrophotographic development method where electrodes are arranged only on the side of the photosensitive layer of a master, developing liquid is supplied between the master and the electrodes, and conductors are made to come into contact with the base of the master so that an electric field is generated between the photosensitive plane and the electrodes for development. The electrode to be used for the electrophotographic development method includes conductive wires of a plural number which are arranged in the direction perpendicular to the traveling direction of the material so as to come into contact with the conductive base thereof. If the electrodes are utilized, a main electrode needs to be arranged only on the side of the photosensitive layer of the master, and developing liquid is supplied therebetween. The electrode is adapted to come into contact with the conductive base of the master, to thereby generate an electric field between the main electrode and the electrode. Therefore, the master can be directly injected with electrons instead of indirect injection, and adhesion of toner scum which often was caused in the prior art can be avoided. This further eliminates the trouble of cleaning the electrodes to improve maintenance.

29 Claims, 18 Drawing Sheets

LIQUID DEVELOPING METHOD AND APPARATUS FOR ELECTROPHOTOGRAPHY, AND ELECTRODES THEREFOR

BACKGROUND OF THE INVENTION

This invention relates to a liquid developing method and apparatus for electrophotography which can develop a sheet of photosensitive material with direct electron injection system and to electrodes therefor.

FIG. 1 shows the structure of a prior art camera-type electrophotographic processor 1 schematically in cross section. In the figure, an original 3 held on an original table 2 is irradiated with light from a light source (not shown), the light is reflected from the surface of the original and a mirror 4 above, and converged by a lens 5. The focused light forms images on a sheet of electrophotographic paper (referred to simply as "master" hereinafter) P which is supplied from a paper feeding section 6 to a exposing section 7 by a conveying means. The exposed master P is conveyed by the conveying means to a developing section 8 for development, fixed at a fixing section 9, processed with etching solution at an etching section 10, dried and then taken out from an outlet 11.

The liquid developing apparatus and its operational principle used generaly at the developing section 8 of such camera-type electrophotographic processor 1 will be outlined below.

FIG. 2 shows a structure in cross section to show schematically a liquid developing apparatus 8A of "single jet system" disclosed in Japanese Patent Laid-open No. 185373/1984 which is most widely used because of a simple structure, low cost and easy maintenance. A main electrode 20 and an auxiliary electrode 21 comprising two electro-conductive members (referred to as "electrodes") applied forward or reverse bias voltage are provided, and a developing liquid discharge means 22 which discharges developing liquid DL is mounted between the main electrode 20 and the master P. A thread-like guide 23 made of nylon or the like is attached above the auxiliary electrode 21 in order to facilitate the passage of the master P as well as to prevent transfer of toner scum from auxiliary electrode to the back surface of the master P. Squeeze rollers 25 are provided further to squeeze out excessive developing liquid from the master P.

In the structure as above, while the master P is being moved over the thread-like guide 23 with the photosensitive surface (imaged surface) thereof facing upward, the charged toner particles within the developing liquid from the developing liquid discharge means 22 adhere to imaged parts on the master P in a predetermined amount depending on the intensity of electric field between the main electrode 20 and the master P to thereby conduct development.

The intensity of the electric field between the main electrode 20 and the master P varies depending on the state (relative dielectric constant) between the auxiliary electrode 21 and the master P, and when the developing liquid DL is filled to fully occupy the space therebetween, the electric field intensity increases to sufficiently attach the toner particles. However, when the air enters the space between the master P and the auxiliary electrode 21, the intensity of electric field is reduced. In a case where a large area on the master P is imaged with pictures or patterns, the toner particles are not adhered uniformly over the area to present irregular and non-uniform density.

As shown in FIG. 3, the master P comprises a base P2 made mainly of conductively processed paper and a photosensitive layer P1 coated thereon. For liquid electrophotographic development, the master P and the developing liquid DL are passed concurrently between the electrodes 20 and 21 which are opposed to each other in parallel at an interval of 1–3 mm. It is therefore necessary to fill not only the side of the photosensitive layer P1 but also the side of the base P2 with the developing liquid DL in order to develop a large area image. More particularly, as shown in FIG. 3, the reason why the base P2 should be filled with the developing liquid DL is because positive charges on the surface of the base P2 on backside of the photosensitive layer P1 is neutralized with negative charges supplied from the counter ion CN of the developing liquid DL. If the counter ion CN adheres on the surface of the base P2, it causes the positive charged toner particle PN to adhere on the side of the auxiliary electrode 21 simultaneously, and if the developing works continue, the many toner particles become adhered on the auxiliary electrode 21 to thereby deteriorate the performance.

It is heretofore necessary to clean the auxiliary electrodes periodically or to add an extra-cleaning apparatus. The maintenance becomes most difficult when the interval between electrodes is narrow and the size of the electrodes large. Especially when a large area image is developed, un-imaged background often becomes non-uniform foggy to lower the quality.

SUMMARY OF THE INVENTION

This invention was conceived to eliminate such problems encountered in the prior art and the primary object of this invention is to provide a liquid developing method and apparatus for electrophotography which can be effectively operated and easily maintained as it can directly inject electrons through a contact conductor without the necessity to provide an electrode on the side of the master base and to fill the developing liquid, and an apparatus thereof.

Another object of this invention is to provide an electrode structure optimal for a liquid developing method for electrophotography which can be effectively operated and simply maintained as it can be directly injected electrons with via contact conductors and is provided with an automatic cleaning function on the contact conductors without necessity to provide an electrode on the case side of the master and to fill the developing liquid.

According to one aspect of this invention, for achieving the objects described above, there is provided a liquid developing method for electrophotography which comprises the steps of, when a photosensitive sheet-like material comprising a photosensitive layer containing photoconductive substance which is coated on a base made of flexible conductive sheet-like substance is liquid developed, supplying developing liquid to the side of said photosensitive layer, arranging electrodes on the same side, contacting conductors with said conductive base, and applying short-circuit or DC voltage between said conductors and said electrodes for development.

According to another aspect of this invention, there is provided a liquid electrophotographic developing apparatus for developing photosensitive materials of the sheet form comprising a base made of flexible conductive sheet-like substance and a photosensitive layer thereon containing photoconductive substance, which comprises rollers for carrying said photosensitive material with said photosensitive layer facing downward, squeeze rollers, conductors arranged between said rollers and said squeeze rollers in a manner to come to contact with a surface of said conductive base in the direction perpendicular to the traveling direction of the material, and a developing liquid supplying means which is provided to oppose said conductors, defines electrodes on the bottom thereof, and supplies the developing liquid between said electrodes and said photosensitive layer.

Further, according to still another aspect of this invention, there is provided an electrode for electrophotographic development which is characterized in that when a photosensitive material in the form of a sheet comprising a photosensitive layer containing photoconductive substance coated on a base made of flexible conductive sheet-like substance is liquid-developed, a plurality of elastic conductive wires are arranged in a manner to come to contact with the conductive base of said material during its travel in the direction perpendicular to said traveling direction.

Still further, according to another aspect of this invention, there is provided an electrode for electrophotographic development which is characterized in that when an electrophotographic material in the form of a sheet comprising a photosensitive layer containing photoconductive substance coated on a base made of flexible conductive sheet-like substance is liquid-developed, a conductive coil-like spring member is supported on both ends thereof on a fixed member and arranged to come to contact with the conductive base of the electrophotographic material which is being traveled for development in the direction perpendicular to the traveling direction of said material.

According to another aspect of this invention, further there is provided an electrode for electrophotographic development which is characterized in that when an electrophotographic material in the form of a sheet comprising a photosensitive layer containing photoconductive substance coated on a base made of flexible conductive sheet-like substance is liquid-developed, a plurality of conductive thread members have conductive bulbs connected on an end thereof respectively and come to contact with said conductive base surface of said electrophotographic material while traveling for development in the direction perpendicular to said traveling direction due to the weight of said conductive bulbs.

Further, according to another aspect of this invention, there is provided an electrode for electrophotographic development which is characterized in that when an electrophotographic material in the form of a sheet comprising a photosensitive layer containing photoconductive substance coated on a base made of flexible and conductive sheet-like substance is liquid-developed, a conductive brush is arranged in a manner that bristles thereof come to contact with the base of said electrophotographic material while traveling in the direction perpendicular to said traveling direction.

Still further, according to another aspect of this invention, there is provided an electrode for electrophotographic development which is characterized in that when an electrophotographic material in the form of a sheet comprising a photosensitive layer containing photoconductive substance coated on a base made of flexible and conductive sheet-like substance is liquid-developed, a conductive coil-like spring member is suspended between two fixed members in the form of a FIG. 8 and is arranged to come to contact with the conductive base of said electrophotographic material during its traveling for development in the direction perpendicular to said traveling direction, and there is provided an electrode for electrophotographic development which is characterized in that when an electrophotographic material in the form of a sheet comprising a photosensitive layer containing photoconductive substance coated on a base made of flexible and conductive sheet-like substance is liquid-developed, conductive member for supplying power is arranged at the downstream of said material, and has elastic irregular surface contacting with the base of said material.

According to still another aspect of this invention, there is provided an electrode for electrophotographic development which is characterized in that when an electrophotographic material in the form of a sheet comprising a photosensitive layer containing photoconductive substance coated on a base made of flexible and conductive sheet-like substance is liquid-developed, a plurality of elastic conductive wires come to contact with the base of said material during its travel for development in the direction perpendicular to the traveling direction, and a driving means drives said conductive wires in a manner to slidingly contact with electrode for development.

The nature, principle and utility of the invention will become more apparent from the following detailed description when read in conjunction with the accompanying drawings.

PREFERRED EMBODIMENTS OF THE INVENTION

Figure 1:
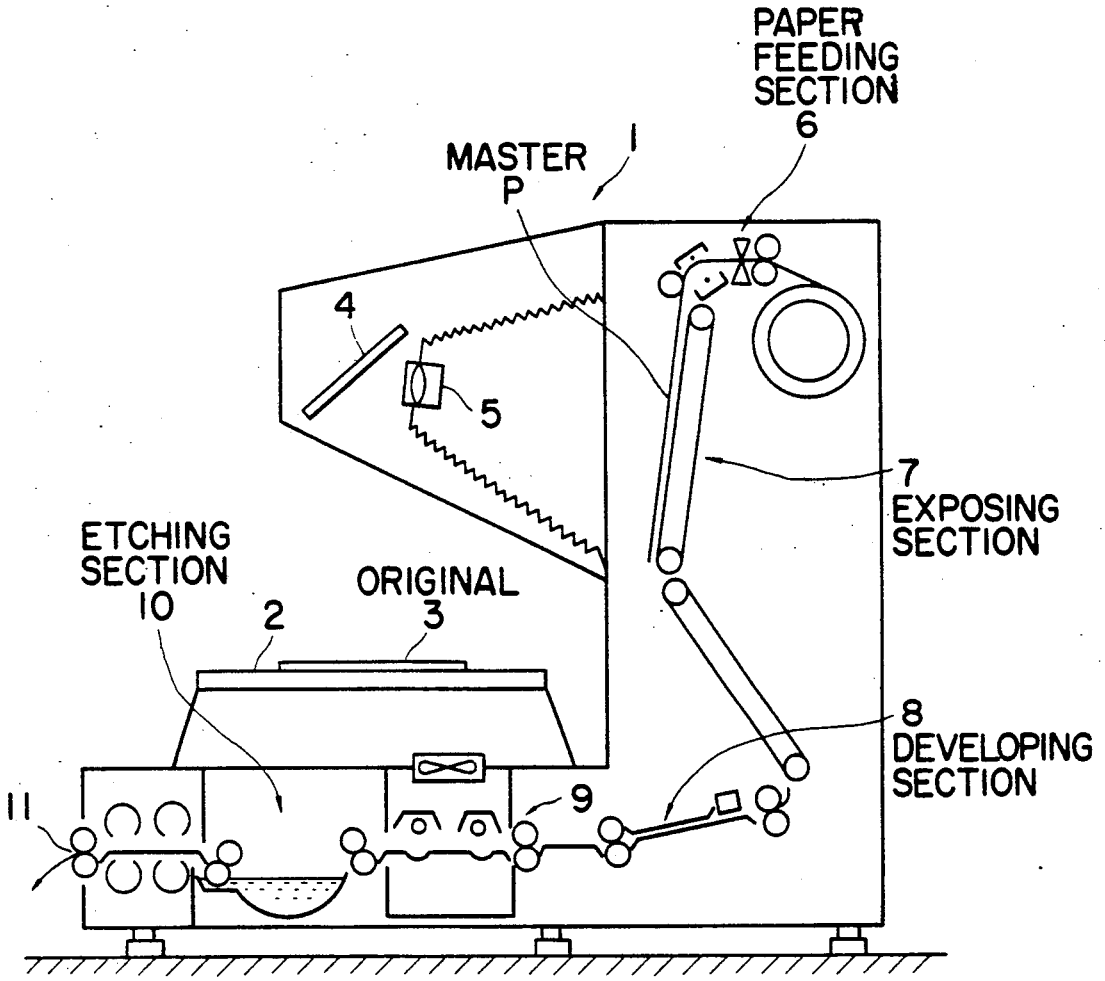
FIG. 1 PRIOR ART
FIG. 1 is a cross sectional structural view to explain a prior art camera-type electrophotographic processor.
Figure 2:
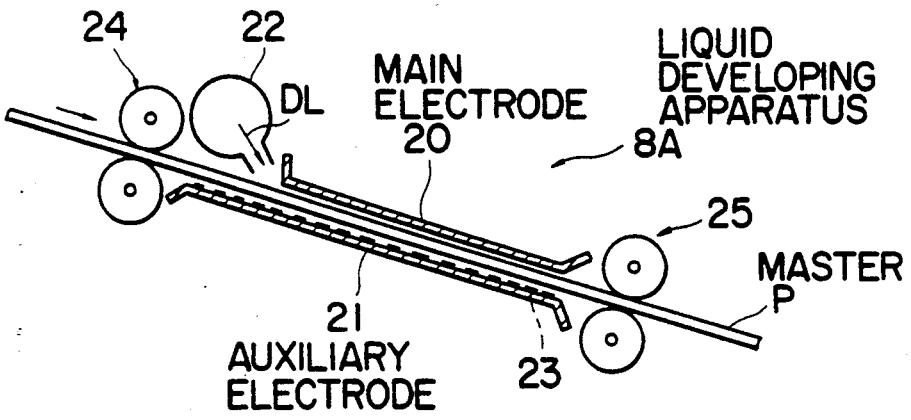
FIG. 2 PRIOR ART
FIG. 2 is a cross sectional structural view to schematically show a prior art a liquid developing apparatus.
Figure 3:
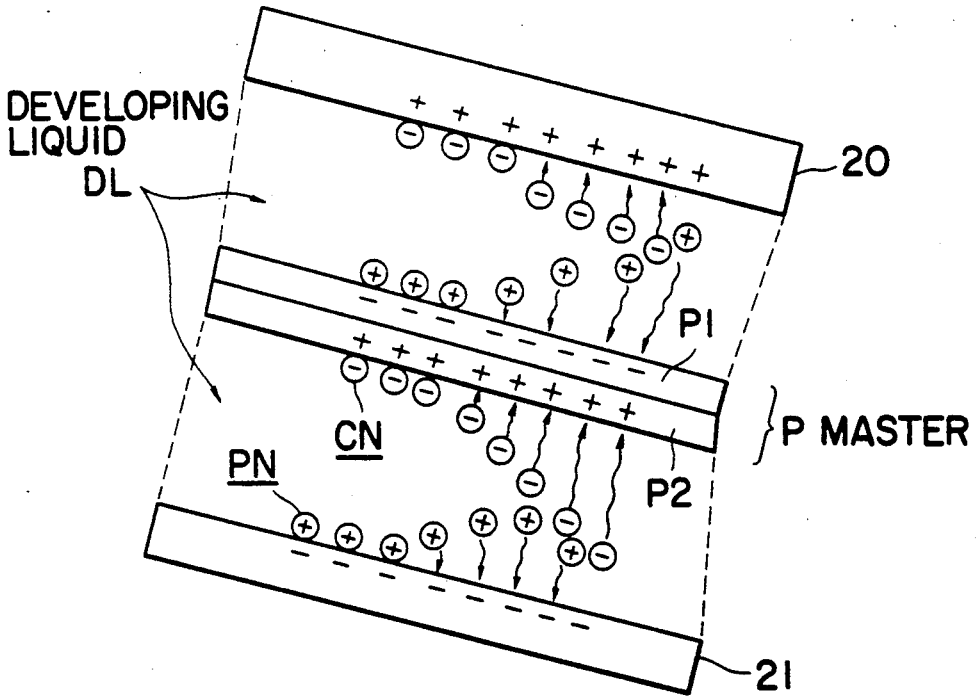
FIG. 3 PRIOR ART
FIG. 3 is a view to explain the state under which toner particles are adhered on electrodes.
Figure 4:
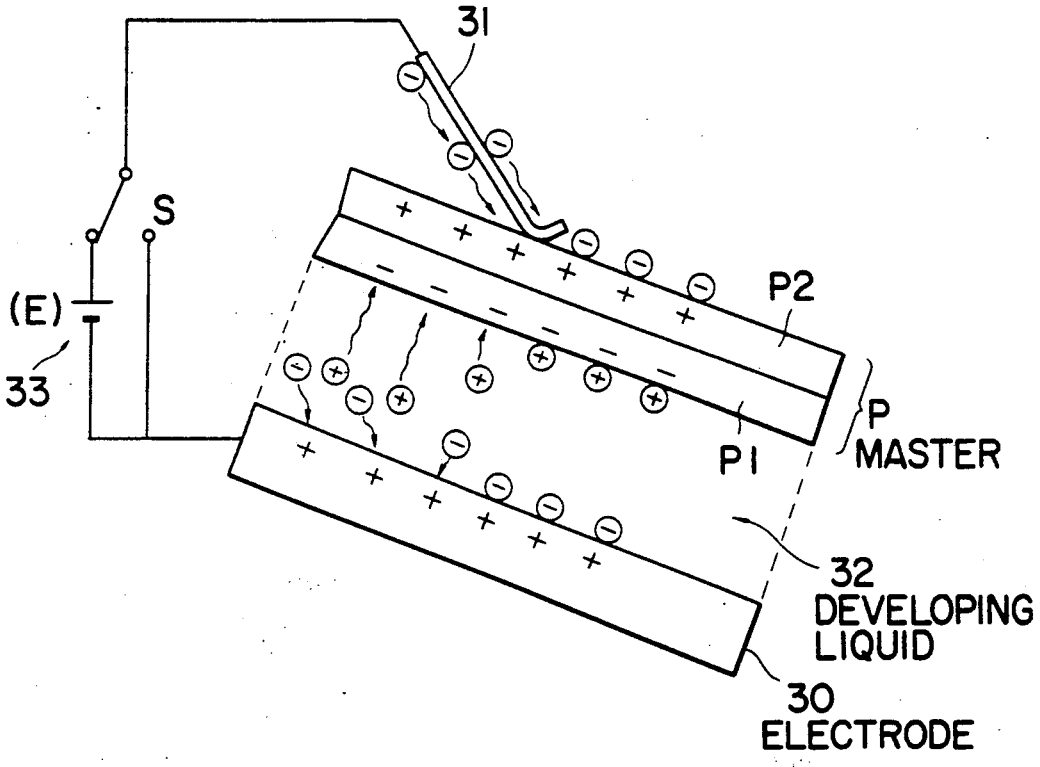
FIG. 4 is an explanation view to show the principle of this invention.

FIG. 4 shows the principle of this invention wherein an electrode 30 is provided on the side of a photsensitive layer P1 of a master P, and developing liquid 32 is supplied between the master P and the electrode 30. The master P is contacted on a base P2 thereof with a conductor 31, and a DC power source 33 with a switch S is provided between the conductor 31 and the electrode 30 in order to provide electric voltage E (including E=0). The conductor 31 may be a hardened steel rod of ca. 0.1 mm diameter and should preferably have elasticity which allows a suitable abutting pressure against the surface of the base P2. Normal volume resistance is $10^5$ to $10^{14}$ Ω, and its surface resistance is $10^3$ to $10^{11}$ Ω. Since the master P is formed as a sheet, it is limited in contact pressure as well as in the number of contacts in order to facilitate light but secure contact. If it is assumed that the traveling speed of the master P is v, the resistance of the base P2 thereof as R, and the contact interval in the direction of width thereof as D, the relation holds closely to the equation shown below in the practical scope wherein a, b and c are constants.

$$V^a \cdot D^b \cdot R^c = \text{constant} \quad (1)$$

$$a,b,c > 0$$

The number and the interval in the direction of width of the conductor(s) 31 may be designed to satisfy the above equation (1). However, the interval D does not need to be considered if an electroconductive film which can be continuously contacted is used as the conductor.

The type of electrophotographic material suitable for the development of the above method is the one comprising a photosensitive layer (photoconductive layer) provided on a flexible conductive base. The base may preferably be paper which has been treated for conductivity, or for conductivity and water proof, or applied or coated on both surfaces with conductive polymer, or polymer base with conductivity. The conductive polymer described herein may be either the polymer which is a conductive polymer the or polymer containing conductive substance. The photosensitive layer herein may be a photoconductive layer containing inorganic photoconductive substance such as zinc oxide, titanium oxide, amorphous silicon, etc. or the photoconductive layer containing an organic photoconductive substance such as phthalocyanine compounds. If necessary, an intermediate layer may be provided between the base and the photoconductive layer, or a backing layer may be provided on the surface of the base opposing the photoconductive layer.

Figure 5:
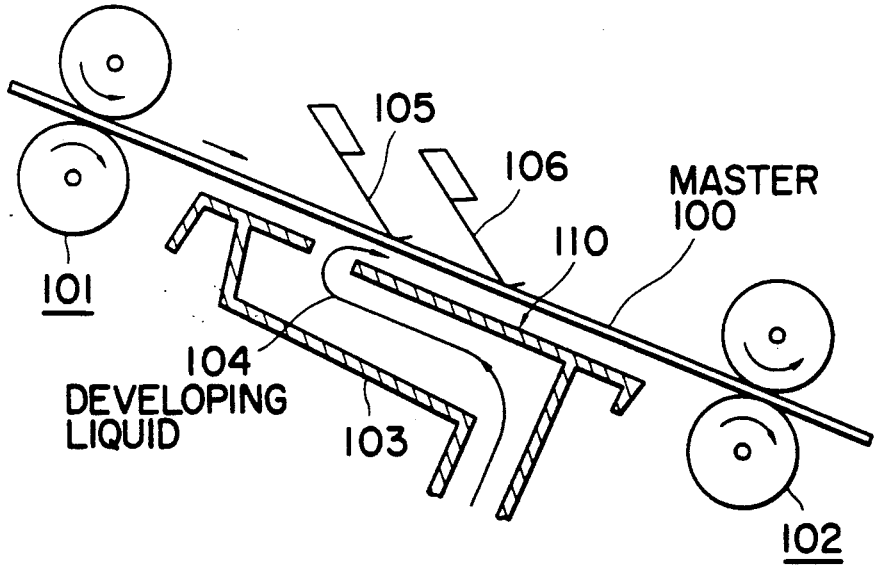
FIG. 5 is a view to show an embodiment of this invention developing apparatus for electrophotography in structure.
Figure 6:
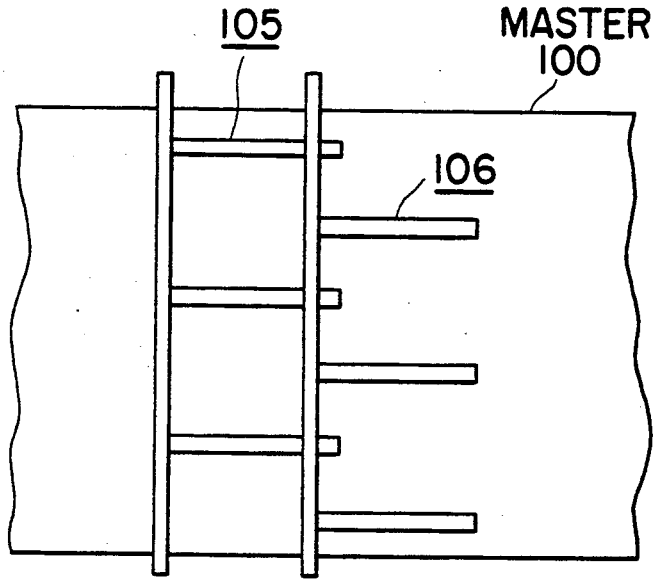
FIG. 6 is a plane view to show an embodiment of a conductor in structure which is to be used for this invention.

FIG. 5 shows an embodiment of the developing section to which this invention method is applied wherein a master 100 is adapted to be conveyed in the direction marked with an arrow with rollers 101 and squeeze rollers 102. The master 100 has the photosensitive layer on the lower surface, and a developing liquid supplying means 103 is provided to supply the developing liquid 104 to the path on the side of the photosensitive layer. The developing liquid supplying means 103 defines an electrode 110 on the plate thereof on the side of the master 100 so that the developing liquid 104 is supplied between the electrode 110 and the master 100. As shown in FIG. 6, conductors 105 and 106 are provided on the side of the base of the master 100 in two rows and at a predetermined interval in the direction of width so that while passing through the developing section, the master 100 may come to contact with the conductors 105 and 106 on the surface thereof. Either short-circuit or DC voltage is applied between the conductors 105, 106 and the electrode 110 so that the photosensitive layer of the master 100 is developed by the movements of electric charges as shown in FIG. 4. In this embodiment, the photosensitive layer of the master 100 faces downward toward the electrode 110.

Figure 7:
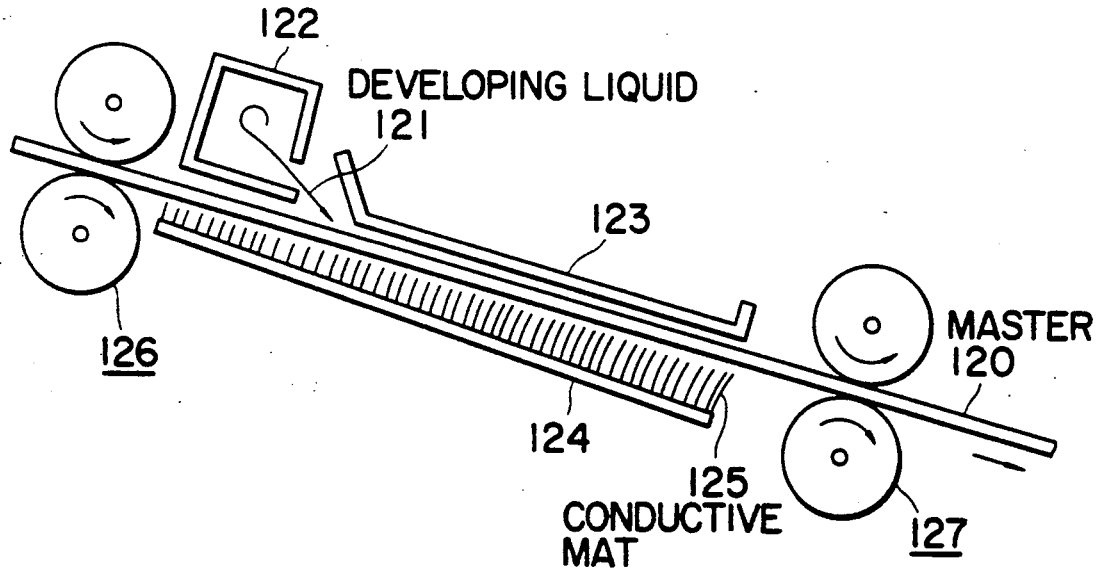
FIG. 7 is a structural view to show another embodiment of a developing apparatus to which this invention method is applied.

FIG. 7 shows another embodiment of the developing section wherein the photosensitive layer is provided on the upper surface of a traveling master 120, and the master 120 is conveyed in the direction marked with an arrow with rollers 126 and squeeze rollers 127. Developing liquid 121 is supplied onto the photosensitive layer by a supplying means 122, and an electrode 123 is provided thereabove so that a conductive mat 125 which is uniformly implanted with conductive bristles on a plate 124 comes to contact with the base of the master 120 to thereby generate an electric field for developing between the photosensitive layer and electrode 123. In other words, neutralizing charges are supplied to the base of the master P via the conductive mat 125.

The above mentioned liquid developing method for electrophotography according to this invention is advantageous in that the toner particles are not adhered on the electrodes as there is no auxiliary electrode used, maintenance of the system is therefore improved. It is further advantageous in that the processing speed can be increased as electrons are supplied with electric charges instead of ions, and the size of the system can be reduced. There is no difference in density between the front end and the rear end of the developing section of the system to thereby achieve uniform images.

Figure 8A:
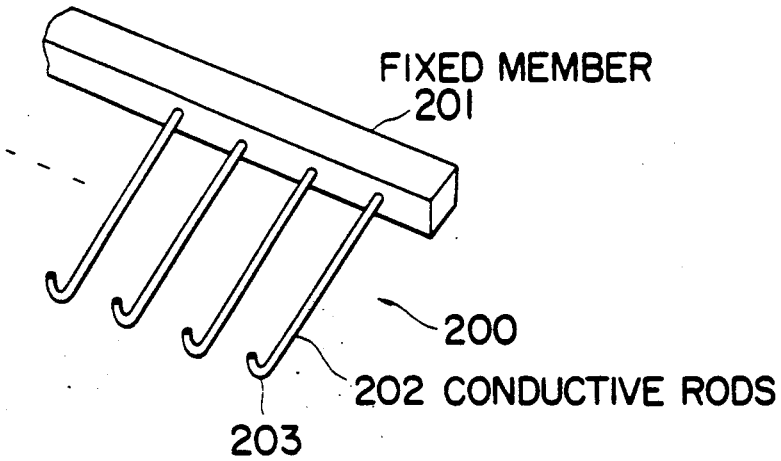
FIG. 8A is a perspective views to show an embodiment of the electrode according to this invention.
Figure 8B:
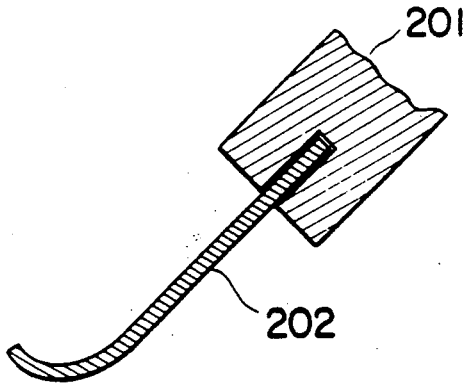
FIG. 8B is a cross sectional view through a fixed member of the electrode.
Figure 9:
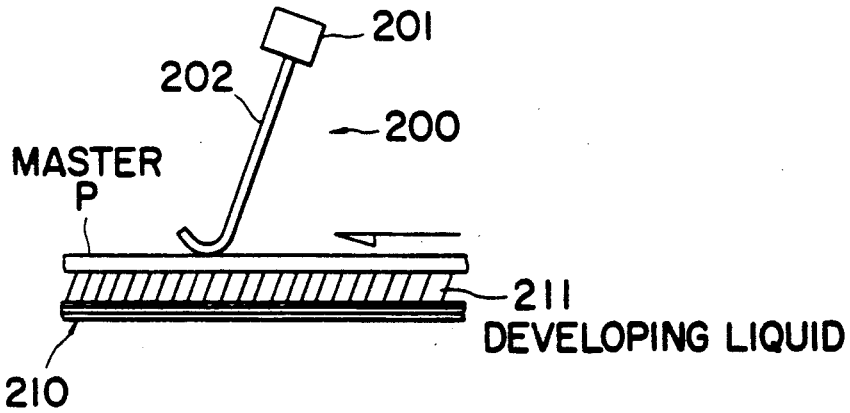
FIG. 9 is a view to show the state of development using the aforementioned electrode.

FIG. 8A shows an electrode 200 for electrophotographic development according to this invention wherein conductive rods 202 having a curved hooks 203 on the tip ends thereof are attached on a fixed member 201 at a predetermined interval to function as power supplying members. Each of the conductive rods 202 is electrically connected via the fixed member 201 or embedded wires (see FIG. 8B). The conductive rod 202 may be conductive metal rods such as of stainless steel or iron which has been thermally treated to give elasticity. The electrode 200 is arranged in a manner that the conductive rods 202 come to contact on the tip ends thereof with the base surface of the master P in the direction of width thereof while the master P is being conveyed as shown in FIG. 9. The developing liquid 211 is supplied between the main electrode 210 and the master P for development. Since the conductive rods 202 are arranged at intervals independently and have elasticity, they can smoothly and securely supply electric charges onto the master P. The interval between the conductive rods 202 in the direction of width may be designed to satisfy the equation (1) above. The electrode 200 may be arranged in multiple levels in the traveling direction of the master P as shown in FIGS. 5 and 6.

Figure 10A:
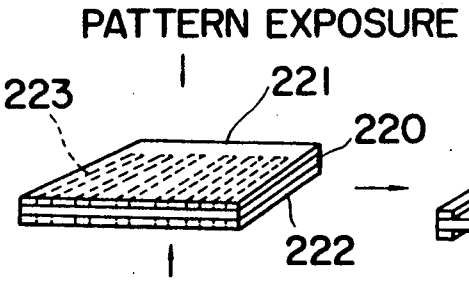
FIGS. 10A through 10D are views to show an example of manufacturing process of the electrode in FIG. 8.
Figure 10B:
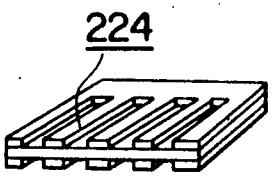
Figure 10C:
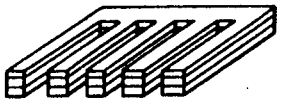
Figure 10D:
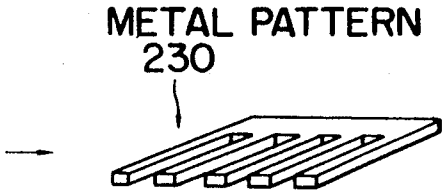

FIGS. 10A through 10D show an example of manufacturing steps of the electrode 200 for the electrophotographic development. In this embodiment, a photo etching process is used. An electrode material comprising a plate-like conductor layer 220 made of conductive metals such as aluminum, copper, iron, stainless steel, etc. which is held between photoresists 221 and 222 is exposed in pattern to the light from above and below as indicated by broken lines in FIG. 10A, and developed to have resists 224 in pattern as shown in FIG. 10B. The patterned plate is then processed with etching solution, etc. to dissolve the conductive layer 220 as shown in FIG. 10C. Then, it is submerged in an organic solvent to dissolve the resists 224 to finally obtain the metal pattern 230 as shown in FIG. 10D. The metal pattern 230 is bent at tip ends to obtain the aforementioned electrodes 200 for electrophotographic development.

Besides metals, the conductive material may be plastics blended with conductive carbon or metals or conductive plastics such as polyacetylene. The material preferably may be hardened iron or stainless steel or conductive plastic reinforced with carbon fibers which have elastic property.

Figure 11A:
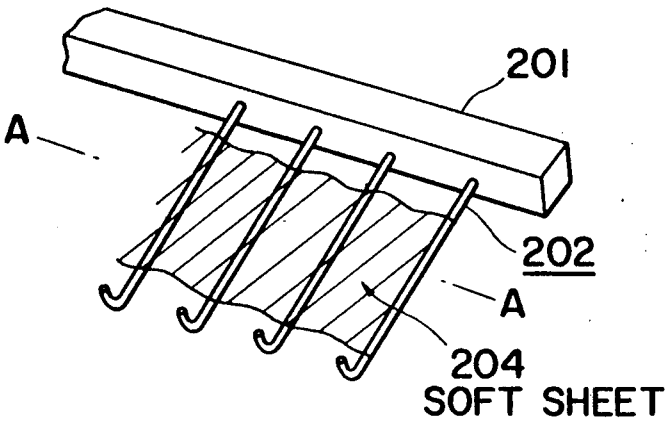
FIG. 11A is a perspective view to show another embodiment of the electrode according to this invention.
Figure 11B:
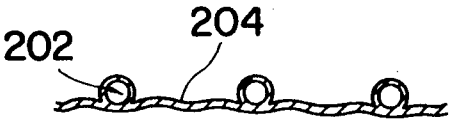
FIG. 11B is a cross sectional structural view thereof along the line A—A.
Figure 12:
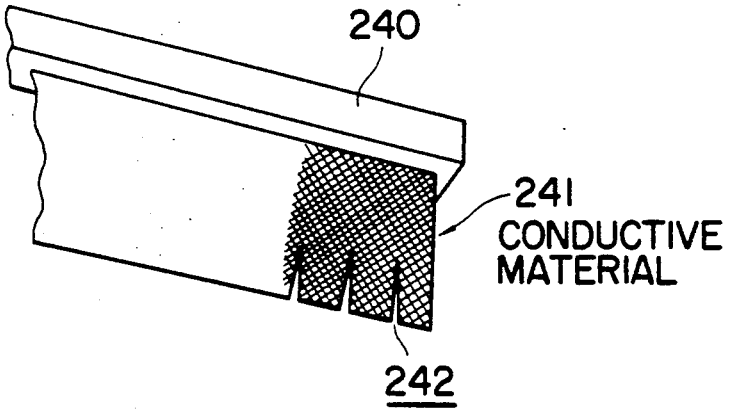
FIG. 12 is a perspective view to show still another embodiment of the electrode according to this invention.
Figure 13:
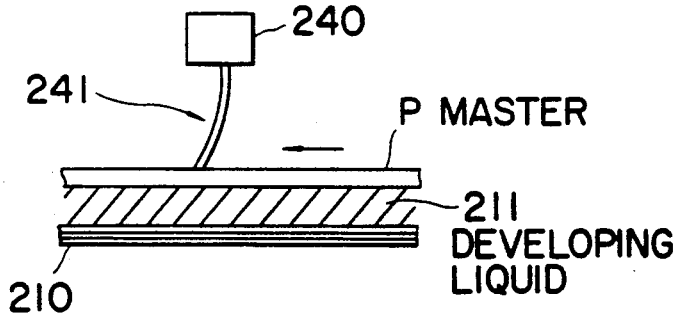
FIG. 13 is a view to show the state of development using the aforementioned electrode.
Figure 14:
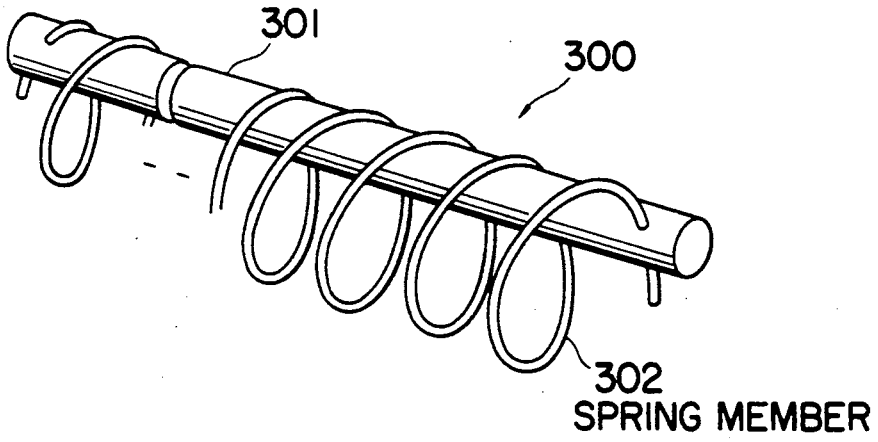
FIG. 14 is a perspective view to show an embodiment of the electrode according to this invention.

Although the developing apparatus shown in FIG. 5 is provided with electrodes in two rows, the number thereof may be arbitrarily selected. The structure of the electrodes is not limited to that shown in FIG. 8, but the conductive rods 202 may be connected to each other with a soft sheet 204 in a manner not to prevent free movement of each rod as shown in FIGS. 11A and 11B. The soft sheet 204 may be made of polyethylene, soft PVC, natural or synthetic rubber, etc. The conductive rods 202 are protected from entanglement with each other by being connected to the soft sheet 204. They may be connected with a cloth-like or code-like material instead of the soft sheet. The cross section of the conductive rod 202 is not limited to circle. Moreover, the conductive rod may be formed by suspending a conductive material 241 in the form of a metal net on a fixed member 240 and giving notches 242 at the lower ends thereof as shown in FIG. 12, and the conductive rod may be provided as shown in FIG. 14. The conductive material 241 may be prepared most suitably by knitting a metal net of stainless steel conductive wires of 0.1 mm or less diameter. It is preferable to use hardened metal or plastics reinforced with carbon fibers which have elasticity.

FIG. 14 shows an embodiment of an electrode 300 for the electrophotographic development according to this invention wherein a coil-like spring member 302 is wound on a fixed member 301 of the column form. The spring member 302 is fixed at both ends of the member 301, but kept freely movable in axial direction at the intermediate portion of the column. The spring member 302 is electricaly connected either through the fixed member 301 or via embedded conductive wires (not shown). The coil-like spring member 302 is of a conductive metal coil made of stainless or iron which has been thermally treated for elasticity. The coil diameter and wire diameter are selected in a manner to allow free upward-downward movement of each coil. Their sizes may be 20 mm in coil diameter and 0.1 to 0.2 mm in wire diameter.

Figure 15:
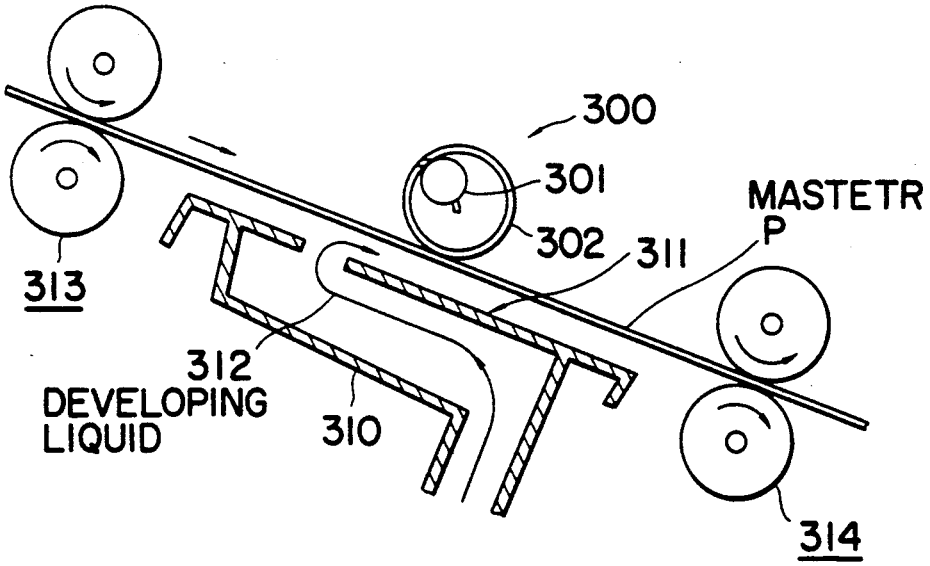
FIG. 15 is a view to show the state of development using the aforementioned electrode.

FIG. 15 shows an embodiment of a developing apparatus to which the electrode 300 for the electrophotographic development is used wherein the master P is conveyed in the direction of an arrow with rollers 313 and squeeze rollers 314. The lower surface of the master P is a photosensitive layer, and a developing liquid supplying means 310 is provided on the path on the side of the photosensitive layer to supply developing liquid 312. The bottom of the supplying means 310 on the side of the master P defines a main electrode 311 so as to supply the developing liquid 312 between the main electrode 311 and the traveling master P. The master P, which passes through the developing section of the developing liquid supplying means 310, is provided on the side of the base with the electrode 300 having the coil-like spring member 302 which is contacting with the surface thereof. The electrode 300 and the main electrode 311 are charged to have the same or predetermined potentials so that the master P on the photosensitive layer thereof is developed with the transfer of the electric charges as shown in FIG. 4. Since coils of the spring member 302 of the electrode 300 are separated and movable independently, electric charges may be securely and smoothly supplied to the master P. The number of windings of the coil-like spring member 302 is designed to satisfy the equation (1) above. The electrode 300 may be provided in multiple stages in the traveling direction of the master P.

Figure 16:
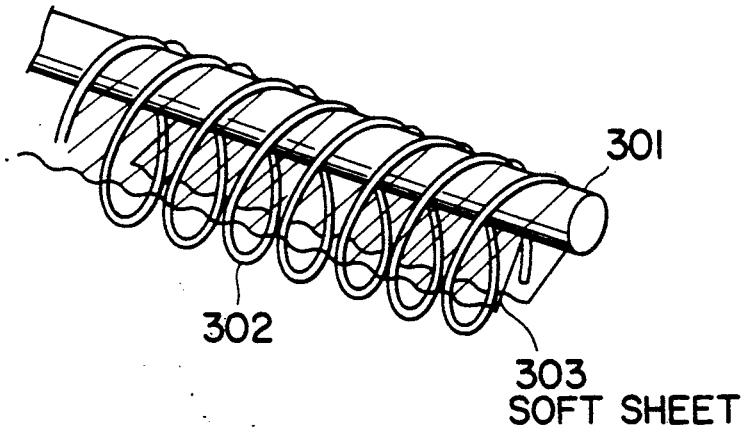
FIGS. 16 and 17 are perspective views to respectively show embodiments of the electrode according to this invention.
Figure 17:
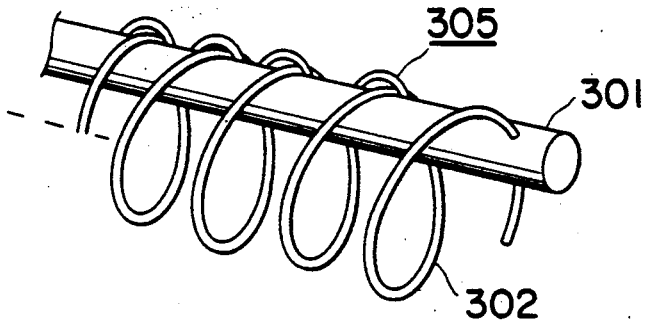

The structure of the electrode 300 may not be limited to that in FIG. 14, but may be that shown in FIG. 16 wherein the coil-like spring member 302 is covered and connected to each other with a soft sheet 303 in the aforementioned manner to prevent the coils from being gathered in either direction. The fixed member 301 may be provided on the upper surface thereof with pins 305 so as to fix the coils to prevent concentration in either of the axial direction.

Figure 18:
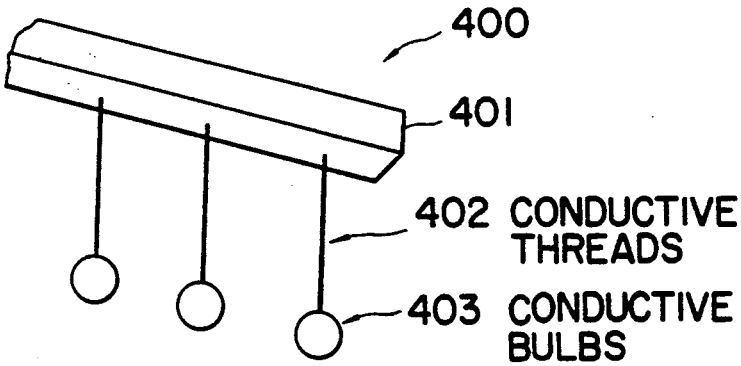
FIG. 18 is a perspective view to show still another embodiment of the electrode according to this invention.

FIG. 18 shows the structure of an electrode 400 for the electrophotographic development according to this invention wherein a fixed member 401 is provided at a predetermined interval with conductive threads 402 which is connected to conductive bulbs 403 made of conductive metal or conductive plastics at the tip ends thereof. The conductive threads 402 and the conductive bulbs 403 are electricaly connected via either the fixed member 401 or an embedded wire (not shown).

Figure 19:
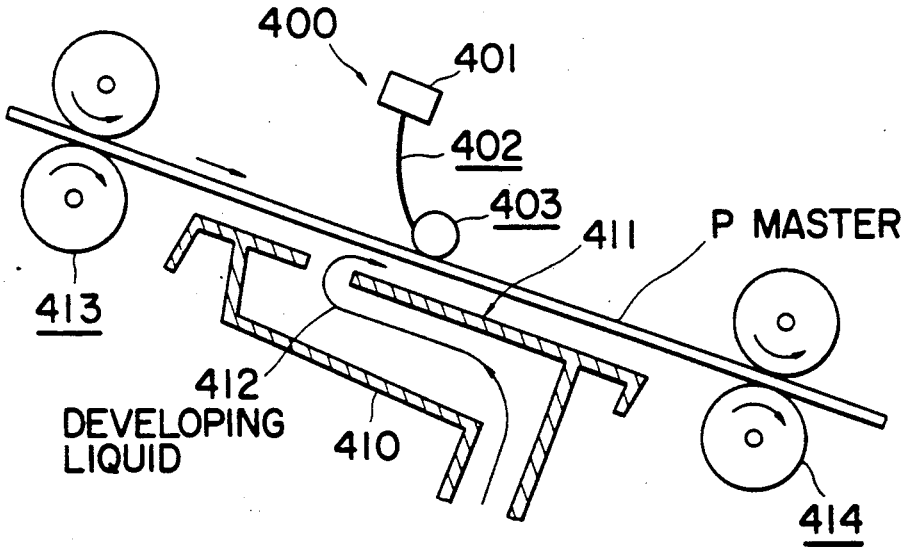
FIG. 19 is a view to show the state of development using the aforementioned electrode.

FIG. 19 shows an embodiment of a developing apparatus in structure with the electrode 400 for the electrophotographic development according to this invention. In the figure, a master P is conveyed in the direction of an arrow with rollers 413 and squeeze rollers 414, and the lower surface of the master P forms a photosensitive layer. Developing liquid supplying means 410 is provided on the path on the side of the photosensitive layer. The bottom of the developing liquid supplying means 410 forms a main electrode 411 on the side of the master P, and the developing liquid 412 is supplied between the main electrode 411 and the traveling master P from the developing liquid supplying means. 410. The electrode 400 is provided on the side of the base of the master P each having a conductive bulbs 403 which comes in contact with the surface of the master P with its own weight. The electrode 400 and the main electrode 411 are charged with the equal potential or with a predetermined potential so that the photosensitive layer of the master P is developed as the charges transfer as shown in FIG. 4. Since the electrode 400 is arranged with threads 402 at intervals, and as the bulbs 403 have their own weights, electric charges can be smoothly and yet securely transferred to the master P. The number and interval in the width direction of the conductive bulbs 403 and the conductive threads 402 may be determined to satisfy the equation (1) above. The electrode 400 may be provided in multiple levels in the traveling direction of the master P. The conductive bulbs attached to the tip ends of the conductive threads may not be completely spherical but may be shaped substantially spherical.

Figure 20:
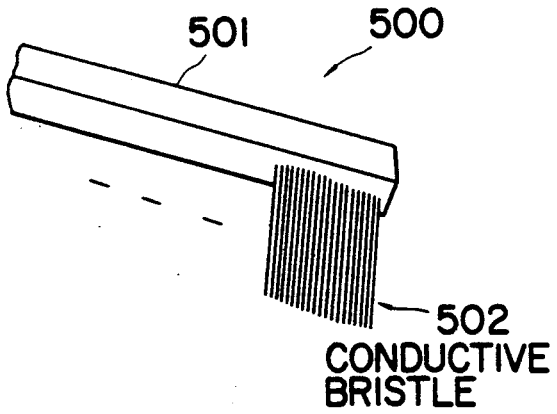
FIG. 20 is a perspective view of an embodiment of the electrode according to this invention.

FIG. 20 shows another embodiment of an electrode 500 for the electrophotographic development according to this invention wherein a conductive bristle 502 is implanted on a rectangular fixed member 501. The conductive bristle 502 is electricaly connected through the fixed member 501 or embedded wires (not shown). The conductive bristle 502 comprises conductive threads and is gathered to form a brush. The materials may be metals, carbon fibers, conductive threads containing metals or carbons, or threads treated for conductivity on surface, and preferably have elasticity.

Figure 21:
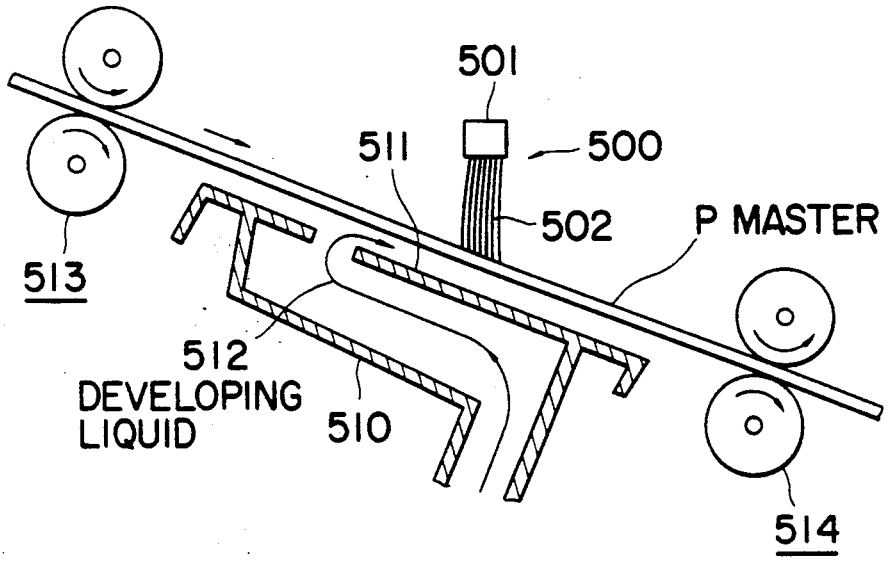
FIG. 21 is a view to show the state of development using the aforementioned electrode.

FIG. 21 shows another embodiment of a developing apparatus with an electrode 500 for the electrophotographic development according to this invention wherein a master P is conveyed in the direction with an arrow with rollers 513 and squeeze rollers 514, and the lower surface of the master P defines the photosensitive layer. A developing liquid supplying means 510 is provided to feed developing liquid 514 on the path on the side of the photosensitive layer. The bottom of the developing liquid supplying means 510 on the side of the master P forms a main electrode 511 to supply the developing liquid 512 between the main electrode 511 and the traveling master P. The electrode 500 is arranged on the base side of the master P in the developing section to extend the bristle 502 thereof onto the surface of the master P. The electrode 500 and the main electrode 511 are charged with an equal or a predetermined potential so that the photo sensitive layer of the master P is developed as the electric charges transfer as shown in FIG. 4.

Figure 22:
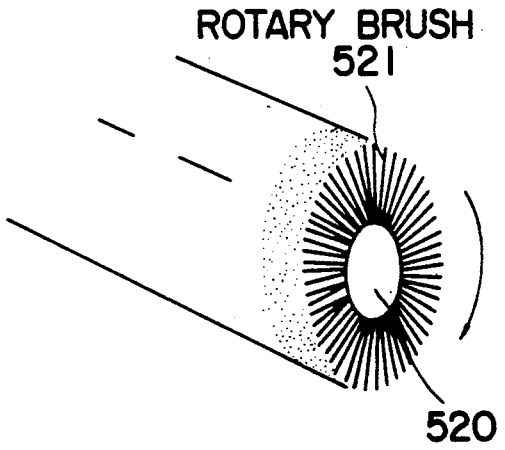
FIG. 22 is a perspective view to show still another embodiment of the electrode according to this invention.

The bristle 502 of the electrode 500 is elastic enough to come to contact with the master P for effective transfer of electric charges. The electrode 500 may be arranged in multiple levels in the traveling direction of the master P. As shown in FIG. 22, the bristle may be implanted on a rotary shaft 520 to form a rotary brush 521.

Figure 23:
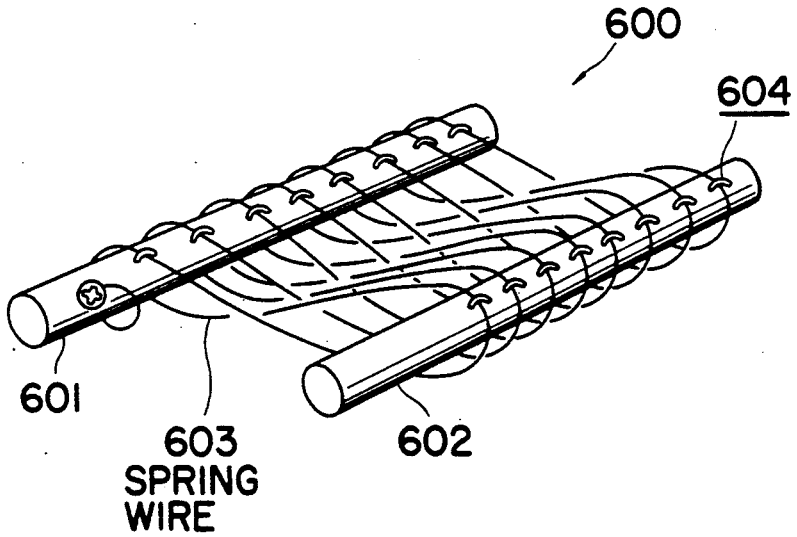
FIG. 23 is perspective view to show still another embodiment of this invention.

FIG. 23 shows the structure of another embodiment of an electrode 600 for electrophotographic development according to this invention wherein column-like fixed members 601 and 602 are arranged in parallel between which is suspended a coil-like spring wire 603 made of a conductive material of a wire form in a predetermined pitch in the axial direction and in the shape of the FIG. 8. The coil-like spring wire 603 is supported at both ends of the fixed members 601 and 602 with pins or the like. The coil-like spring wire 603 is prevented from moving axially with clasps 604 on the column surfaces. The coil-like spring wire 603 is electrically connected through either the fixed members 601 and 602 or embedded wires (not shown). The spring wire 603 is made of stainless steel or iron conductive metal coil which has been thermally treated for elasticity. The diameter of the spring wire 603 is selected so to allow free movement of each coil thereof (e.g. 0.1 to 0.2 mm).

Figure 24:
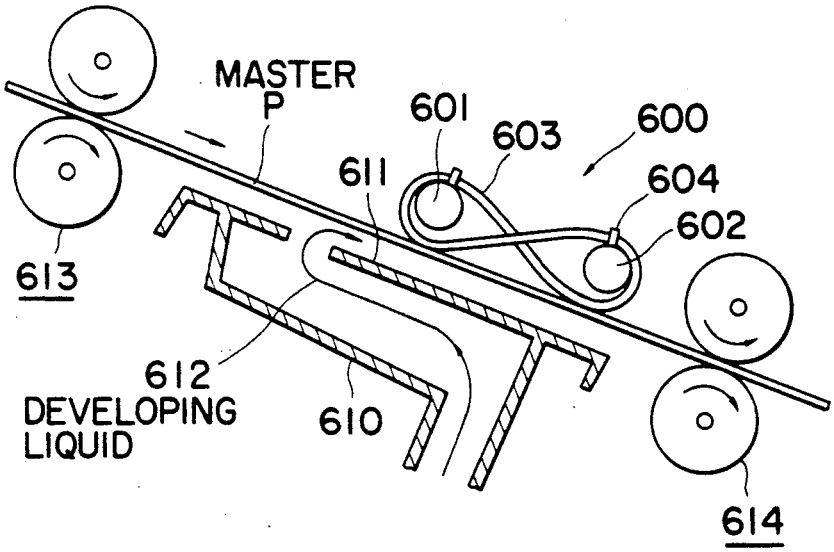
FIG. 24 is a view to show the state of development using the aforementioned electrode.

FIG. 24 shows an embodiment of a developing apparatus with an electrode of the electrophotographic development according to this invention wherein a master P is conveyed in the direction marked with an arrow with rollers 613 and squeeze rollers 614, and the lower surface of the master P defines a photosensitive layer. A developing liquid supplying means 610 for supplying developing liquid 612 to the path on the side of the photosensitive layer is provided. The bottom of the developing liquid supplying means 610 on the side of the master P defines a main electrode 611 so as to supply developing liquid 612 between the traveling master P and the main electrode 611. The electrode 600 having coil-like spring wire 603 is arranged on the side of the base of the master P in the zone of development, and the spring wire 603 is arranged to contact with the surface of the master P. Since the electrode 600 and the main electrode 611 are kept charged with an equal or a predetermined potential, the photosensitive layer of the master P is effectively developed with the movement of electric charges as illustrated in FIG. 4.

Coils of the spring wire 603 comprises the electrode 600 are separated from each other and pinned with clasps 604 to prevent axial movement. Since they have elasticity, electric charges can be securely and smoothly supplied to the master P. The number of windings of the spring wire 603 may be determined to satisfy the equation (1) above. The electrode 600 may be arranged in multiple levels in the advancing direction of the master P.

As described in detail in the foregoing statement, the electrodes for this invention electrophotographic development are advantageous in that it does not need auxiliary electrodes and therefore eliminates the possibility of toner particle adherence on electrodes which is otherwise caused by electrode position, thus remarkably enhancing maintenance performance. This invention electrodes are highly efficient as they are injected electrons instead of ion via the developing liquid to thereby enhance the speed of the developing process as well as minimize the size of the apparatus. They are effective in developing even a large area image with uniform density, and are capable of eliminating non-uniform fog on the background or un-imaged portions. Since coils of an electrode are elastic and freely movable independent of each other, they can come to contact with the master P on the reverse surface thereof even if the surface is irregular or curled to secure electron supply.

Figure 25:
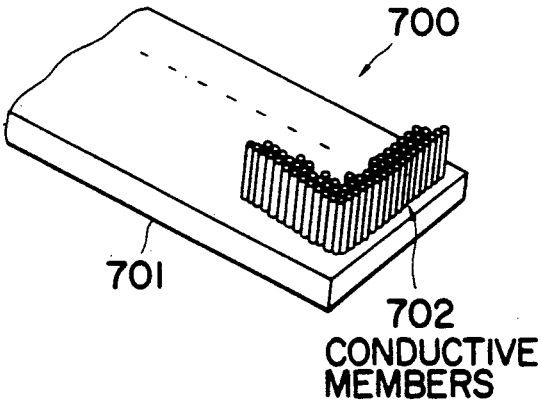
FIG. 25 is a view to show still another embodiment of the electrode according to this invention.

FIG. 25 shows another embodiment of an electrode 700 for the electrophotographic development according to this invention wherein a plate like fixed member 701 is implanted with conductive members 702 in the form of bristles, and the conductive members 702 are electrically connected through the fixed member 701 or embedded wires (not shown). The conductive members 702 are made of rubber, plastic or elastic wires which either contain conductive substances or are treated on the surface for conductivity.

Figure 26:
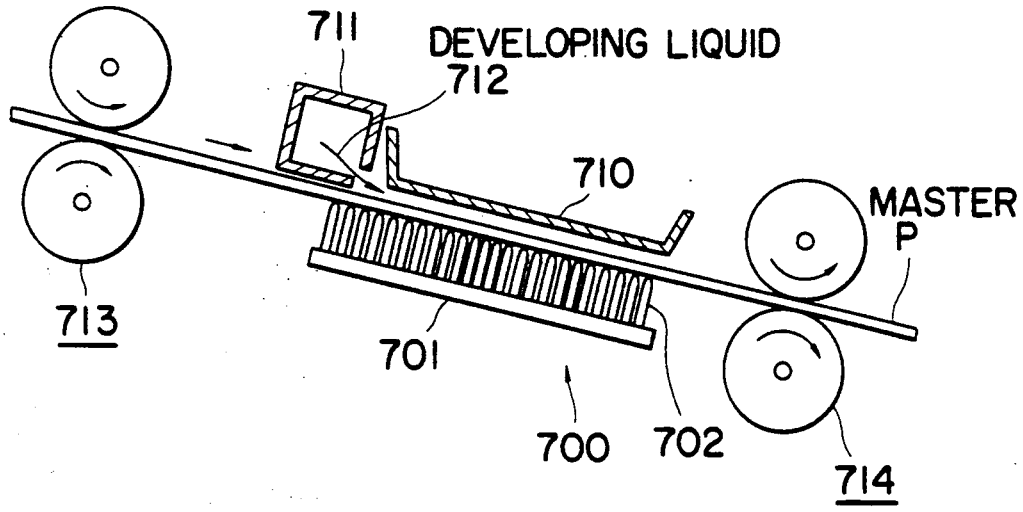
FIG. 26 is a view to show the state of development using the aforementioned electrode.

FIG. 26 shows an embodiment of a developing apparatus with an electrode 700 of the electrophotographic development according to this invention wherein a master P is conveyed in the direction marked with an arrow with rollers 713 and squeeze rollers 714. The upper surfaces of the master P forms a photosensitive layer, and a developing liquid supplying means 711 to supply developing liquid 712 to the path on the side of the layer is also provided. The electrode 700 having conductive members 702 in the needle form are arranged on the side of the base of the master P which is traveling in the development section. The conductive members 702 come to contact with the surface of the master P. Since the electrode 700 and the main electrode 710 are kept charged with the forward or reverse bias voltage potential, the master P on the photosensitive layer thereof is developed with the electric charge transfer as illustrated in FIG. 4. The photosensitive layer of the master P in this embodiment faces upward toward the main electrode 710.

In this case, since the upper surfaces of the conductive members 702 of the electrode 700 contact with the base of the master P, the master P is certainly supplied with electric charges smoothly.

Figure 27:
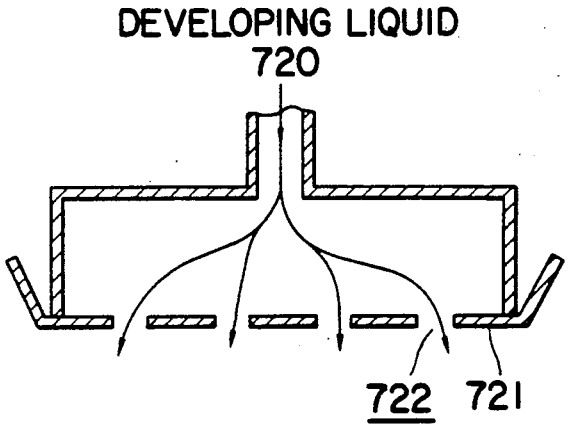
FIG. 27 is a structural view to show an embodiment of a developing liquid supplying means (main electrode)
Figure 28:
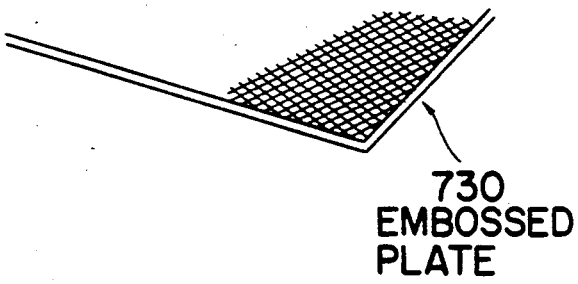
FIG. 28 is a view to show still another embodiment of the electrode according to this invention.
Figure 29:
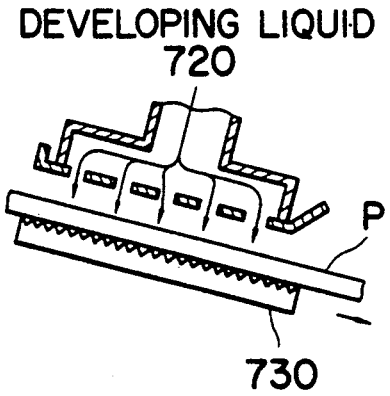
FIG. 29 is a structural view to show a developing section using the electrode shown in FIGS. 27 and 28.

Although the main electrode 710 and the developing liquid supplying means 711 are separated in the embodiment shown in FIG. 26, they may be shaped integral as shown in FIG. 27 wherein the bottom 721 of the means for developing liquid supply defines a main electrode while the developing liquid 720 is fed through several inlets 722 on the bottom surface 721. The electrodes may be embossed plates 730 as illustrated in FIG. 28, which may be arranged as shown in FIG. 29 for development. The embossed plate 730 is desirably made of elastic and conductive rubber.

As described in detail in the foregoing statement, the electrodes for this invention electrophotographic development are advantageous in that it does not need auxiliary electrodes and therefore eliminates the possibility of toner scum adherence on electrodes which is otherwise caused by electrodeposition, thus remarkably enhancing maintenance performance. This invention electrodes are higher in efficiency as they are electrically connected instead of ions via the developing liquid to thereby enhance the speed of the developing process as well as minimize the size of the system. They are effective in developing even a large area image with uniform density, and are capable of eliminating fogs on the unimaged portions.

Figure 30:
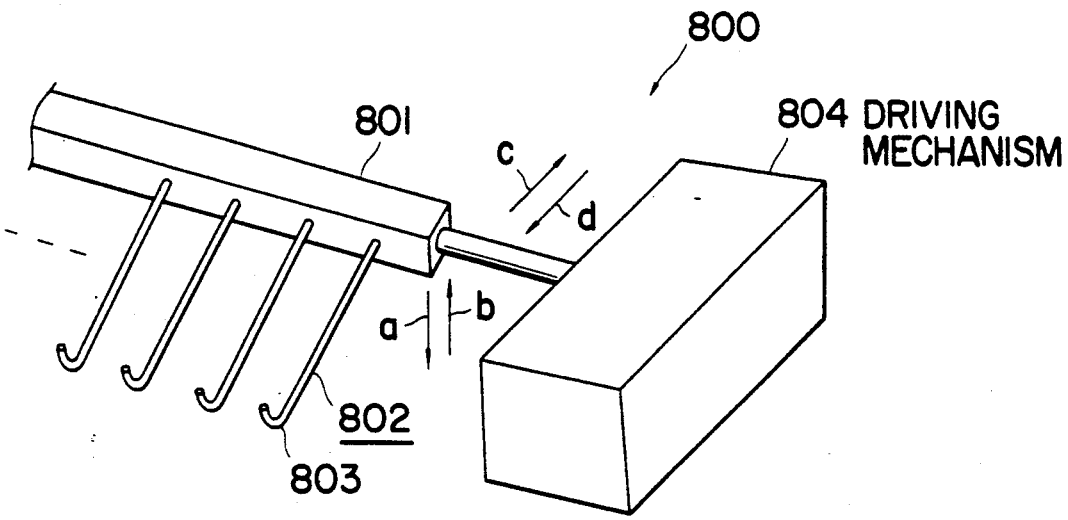
FIG. 30 is a perspective view to show an embodiment of a movable electrode according to this invention.
Figure 31A:
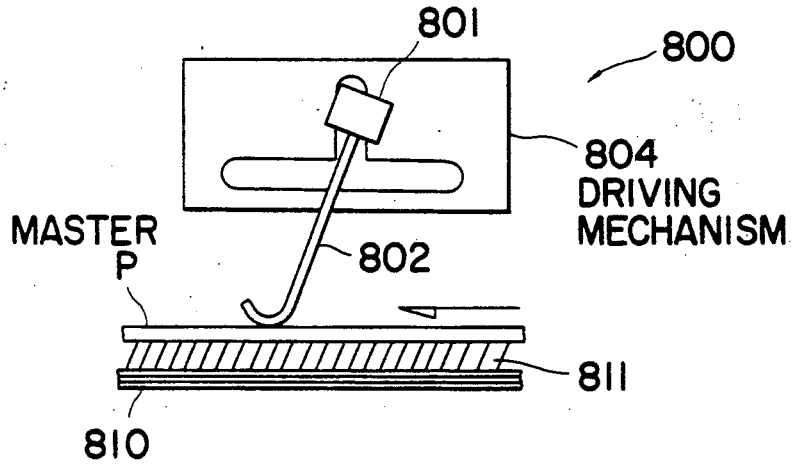
FIG. 31A is a view to show the state of development using the aforementioned electrode.
Figure 31B:
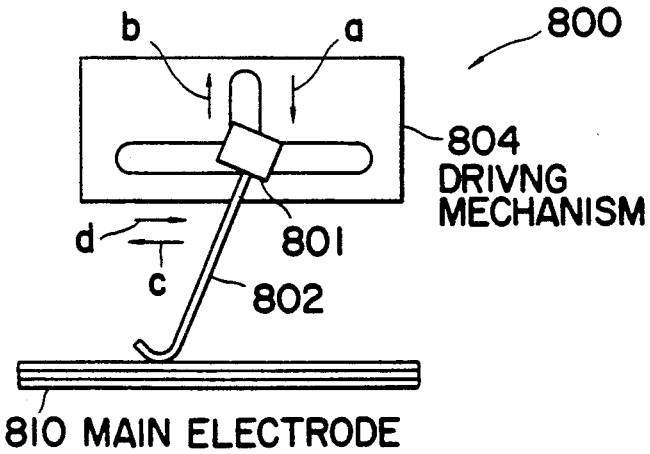
FIG. 31B is a view to show the state of removing toner particles.

FIG. 30 shows the structure of another embodiment of an electrode 800 of a movable type for the electrophotographic development according to this invention wherein conductive rods 802 having needle-like curved portions on tip ends thereof are attached on a fixed member 801 at a predetermined interval to inject electrons. Each conductive rod 802 is injected through either the fixed member 801 or embedded wires (not shown). The conductive rod 802 may be made of conductive metals such as stainless steel or iron which have been treated thermally for elasticity. The conductive rod 802 has a circular cross section. The fixed member 801 is supported on one end thereof and moved reciprocatingly in the directions marked with arrows a and b. A driving mechanism 804 comprising a motor (not shown) and gears (not shown) is provided in order to reciprocate the fixed member 801 in the directions marked with arrows c and d when it comes to the position at the outermost end in the direction with the arrow a. By arranging such electrode 800 in the direction of the width of the master P which is traveling as illustrated in FIG. 31A, developing liquid 811 is supplied between the main electrode 810 and the master P to thereby achieve effective development. Since the conductive rods 802 of the electrode 800 are separated between the conductive rods 802 from each other and are elastic, the supply of electric charges to the master P is secured in a smooth manner. When toner scum is adhered on the conductive rods 802, the fixed member 801 is driven by the driving mechanism 804 to move in the direction marked with the arrow a in FIG. 31B to thereby contact the conductive rods 802 with the main electrode 810, and then to move reciprocally in the directions marked with arrows c and d to slide the conductive rods 802 over the main electrode 810 to scrape off the toner scum from the conductive rods 802. Then, the fixed member 901 is driven by the driving mechanism 804 to move in the direction of the arrow b to return to the original position. Although the toner scum is scraped off by reciprocal movement in the directions of arrows c and d in this embodiment, the same effect may be attained by minute vibration in any direction.

Figure 32:
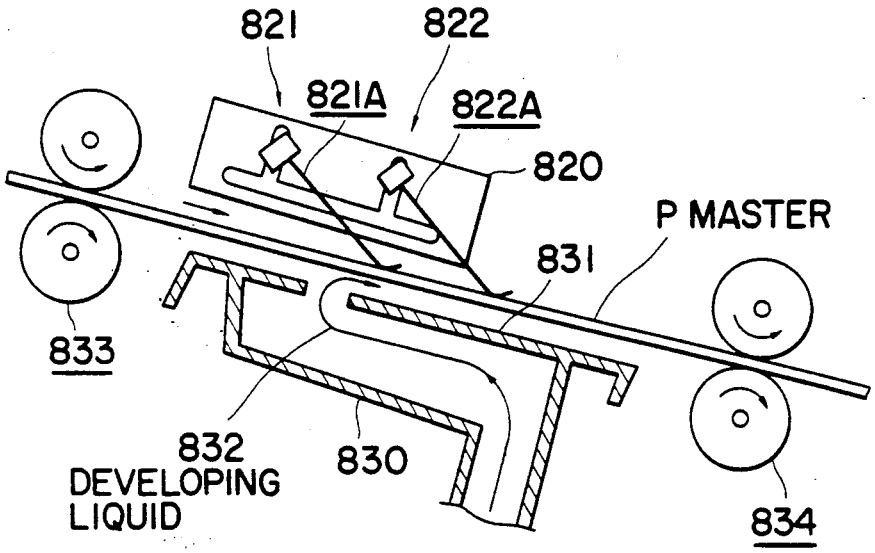
FIG. 32 is a structural view to show a developing section using the electrode shown in FIG. 30.

FIG. 32 shows another embodiment of the developing apparatus with the electrode 800 wherein the master P is conveyed in the direction marked with an arrow by rollers 833 and squeeze rollers 834, and the lower surface of the master P defines the photosensitive layer. A developing liquid supplying means 830 to supply developing liquid 832 is provided on the path on the side of the photosensitive layer. The bottom of the developing liquid supplying means 830 on the master P side forms a main electrode 831 so that the developing liquid 832 is supplied between the main electrode 831 and the master P from the developing liquid supplying means 830. The electrode 821 and the main electrode 822 having conductive rods 821A and 822A press and contact the surface of the master P on the side of the base which is traveling through the developing section. A driving mechanism 820 is structured to drive the electrodes 821 and 822 integrally. DC electric field is generated between the electrodes 821 and 822 and the main electrode 831 to thereby develop the photosensitive layer of the master P with the transfer of electric charges. Toner scum is scraped off, if adhered, by actuating the driving mechanism 820 either manually or automatically. In this embodiment, the photosensitive layer of the master P faces downward toward the main electrode 831.

Figure 33:
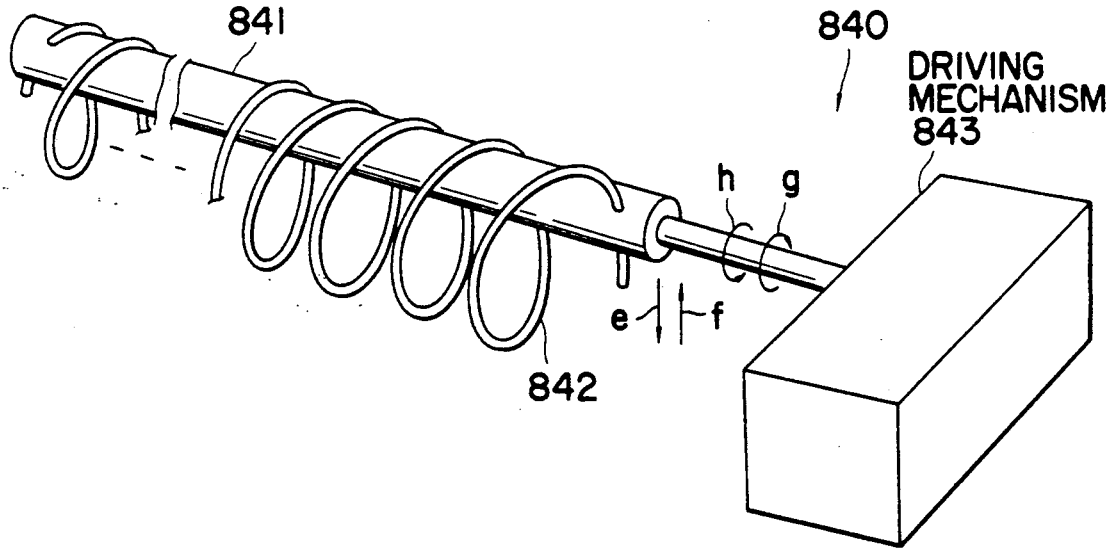
FIG. 33 is a perspective view to show still another embodiment of the movable electrode according to this invention.

FIG. 33 shows the structure of another embodiment of an electrode 840 for the electrophotographic development according to this invention wherein a coil-like spring 842 is suspended on a columnar fixed member 841. The spring 842 is fixed at both ends of the fixed member 841 in a manner to alows free movement of the intermediate portion thereof. The spring 842 is injected with electrons via the fixed member 841 or embedded wires (not shown). The spring 842 is made of conductive metal coils such as stainless steel or iron which is thermally treated for elasticity, and has a circular cross section. The coil diameter or wire diameter is selected in a manner to allow free upward/downward movement of each coil, and may be, for example, 20 mm in coil diameter and 0.1 to 0.2 mm in wire diameter. There is further provided a driving mechanism 843 comprising a motor (not shown) and gears (not shown) for reciprocating the fixed member 841 in the directions marked with arrows e and f and rotating the same in the direction g or h when the fixed member 841 comes to position at the outermost end in the direction of e.

Figure 34A:
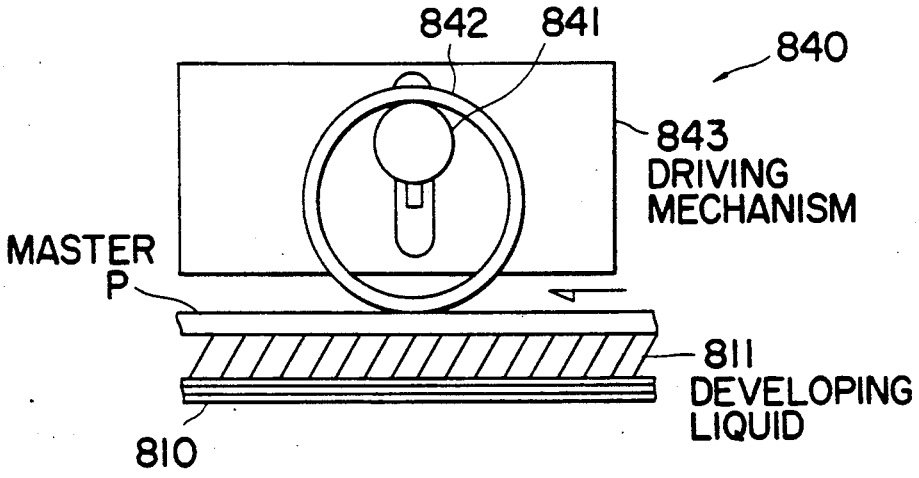
FIG. 34A is a view to show the state of development using the aforementioned electrode.
Figure 34B:
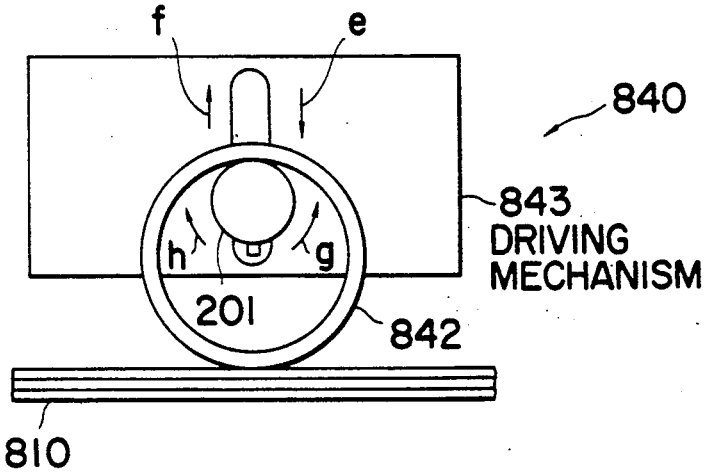
FIG. 34B is a view to show the state of removing toner particles.

By arranging the electrode 840 in the width direction of the master P as illustrated in FIG. 34A, developing liquid 811 can be fed between the main electrode 810 and the master P and electrons are supplied to the electrodes 840 and the main electrode 810 for development.

In this case, since the spring member 842 of the electrodes 840 has coils separated from each other to move freely and independently, and as the member 842 has elasticity, the master P is securely and smoothly supplied with electric charges.

Figure 35:
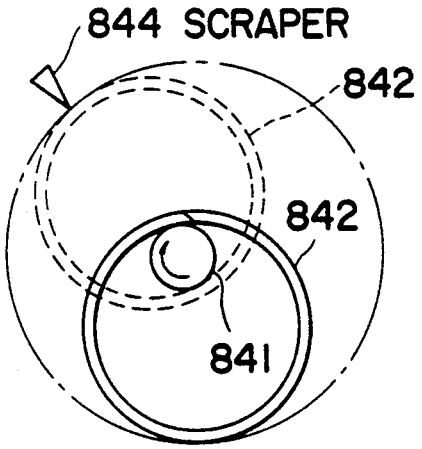
FIGS. 35 and 36 are views to show respectively another embodiment of the electrode shown in FIG. 33.
Figure 36:
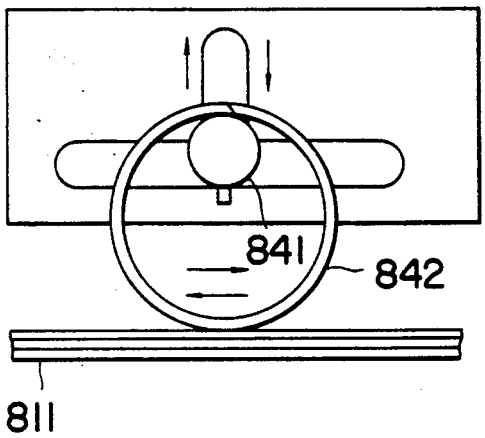
Figure 37:
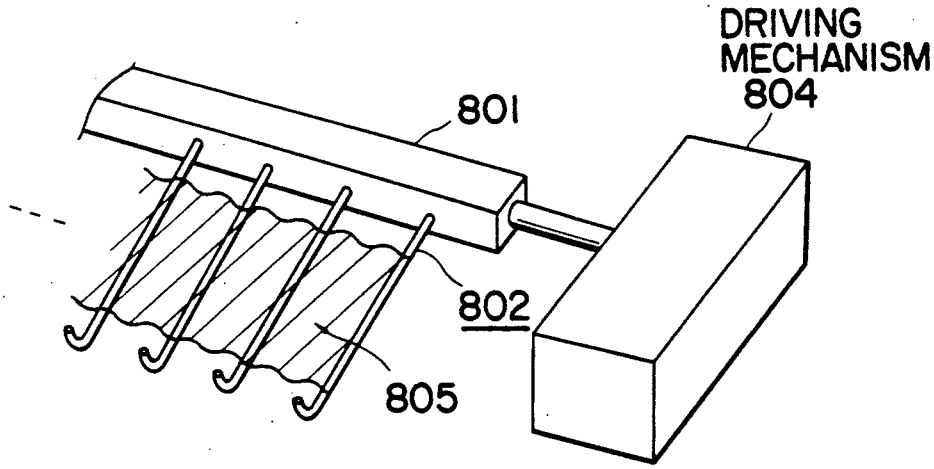
FIGS. 37 through 39 are perspective view to show still another embodiments of the movable electrode respectively.
Figure 38:
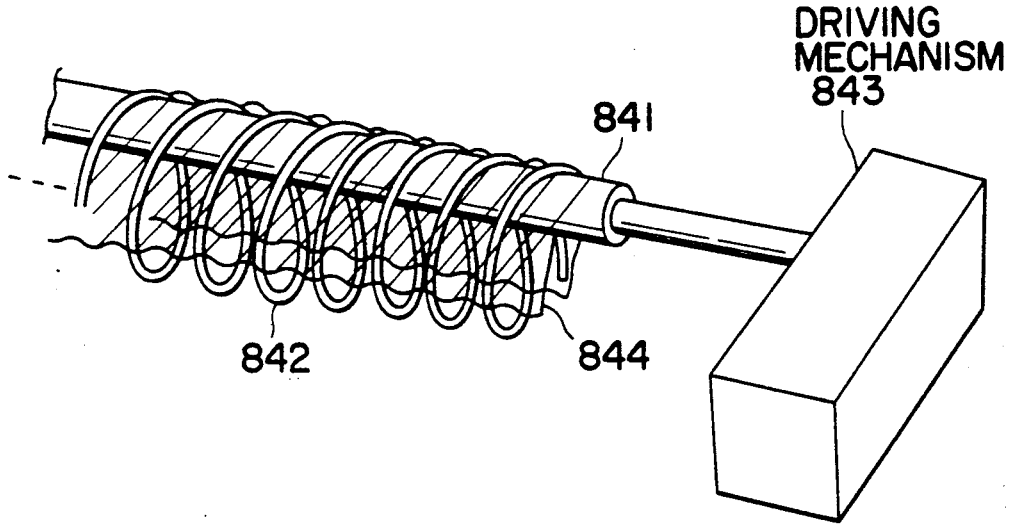
Figure 39:
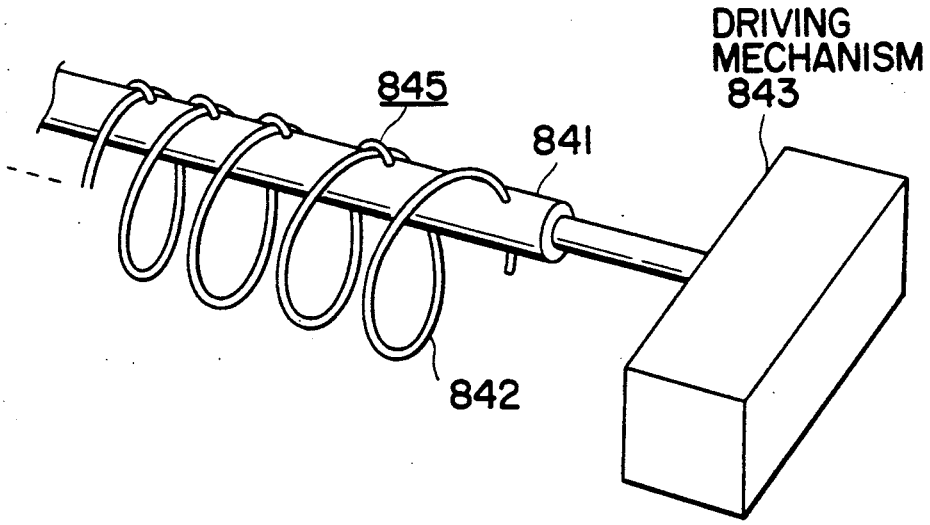

When the toner scum is adhered on the coil-like spring 842, the fixed member 841 is moved by the driving mechanism 843 in the direction of the arrow e to cause the spring 842 to contact with the main electrode 810, to rotate the spring 842 in the direction of arrow g or h to slidingly move the spring 842 over the main electrode 810, and thereby to scrape off the toner scum adhered on the spring 842. After having scraped off the toner scum, the spring 842 is driven back to the original position by moving it in the direction of the arrow f by the driving mechanism 843. If a blade-like scraper 844 is provided within the radius of the movement of the spring 842 as shown in FIG. 35, toner scum would be more effectively removed. The spring 842 may be rotated at its original position without moving it to contact with the main electrode 810 (or the movement in the direction of the arrow e) to be scraped off of the adhered scum by the blade-like scraper 844 arranged within the radius of the movement of the spring 842 to achieve the same effect. Although the spring 842 is rotated in this embodiment, the same effect could be attained by reciprocal movement or minutes vibration as shown in FIG. 36.

The electrode 800 in FIG. 30 may have conductive rods 802 which are connected with a soft sheet 805 in a manner not to prevent movements of each rod. The section is not limited to the circular shape.

As stated above, movable type electrodes for the electrophotographic according to this invention is advantageous in that, as it requires no auxiliary electrode, there is less possibility to stain electrodes with electrode position of toner scum, and even stained, the scum could be easily removed automatically.

It should be understood that may modifications and adaptations of the invention will become apparent to those skilled in the art and it is intended to encompass such obvious modifications and changes in the scope of claims appended hereto.

What is claimed is:

1. A liquid developing method for electrophotography in which a photosensitive sheet-like material, comprising on one side a photosensitive layer containing a photoconductive substance coated on a base made of flexible conductive sheet-like substance having a volume resistance and a back side surface resistivity of $10^7$–$10^{10}\Omega$, is liquid developed as it is conveyed in a transfer direction, comprising the steps of:

supplying developing liquid to said one side of said photosensitive material having said photoconductive substance layer, arranging at least one stationary electrode adjacent said one side, contacting the surface of said conductive base with a plurality of conductors arranged transverse to said transfer direction and operative to avoid penetration of said base, and applying short-circuit or DC voltage between said conductor and said electrodes for promoting electrophotographic development.

2. A liquid developing method as claimed in claim 1, further comprising the steps of:

disposing said conductors intermittently in the direction transverse to the transfer direction of said photosensitive material, and causing said conductors at tip ends thereof to come into contact with the base surface of said photosensitive material as it travels in said transfer direction.

3. A liquid developing method as claimed in claim 1, wherein said photosensitive material is being carried with said photosensitive layer thereof facing downward.

4. A liquid developing method as claimed in claim 1, wherein said method is applied to the development of photosensitive material in a planographic process.

5. A liquid developing method as claimed in claim 1, further comprising the step of:

disposing said plurality of conductors at even intervals.

6. A liquid developing apparatus for use in developing photosensitive material in sheet form comprising a base of a flexible conductive sheet-like substance and a photosensitive layer thereon containing a photoconductive substance, which comprises:

transfer rollers for urging said photosensitive material in a transfer direction with said photosensitive layer facing downward;

squeezing rollers oriented downstream of said transfer rollers in said transfer direction;

a plurality of conductor means arranged between said transfer rollers and said squeeze rollers, said plurality of conductor means being operative to come into contact with the surface of said conductive base and being disposed in a direction transverse perpendicular to the transfer direction of the material at even intervals so as to contact the surface of said conductive base over a full width thereof to attendantly provide a high density contact, and a developing liquid supply means which is provided along said transfer direction at a position opposite to said plurality of conductor means, said liquid supplying means comprising a main electrode on the bottom thereof and being operative to supply the developing liquid between said main electrode and said photosensitive layer.

7. A liquid developing apparatus as claimed in claim 6, wherein said conductors are arranged intermittently in the direction perpendicular to the traveling direction of said photosensitive material at a substantially uniform interval and in serveral stages in said direction.

8. An electrode for use in the electrophotographic development of a photosensitive material in the form of a sheet comprising a photosensitive layer containing a photoconductive substance coated on a base made of a flexible conductive sheet-like substance, said material being liquid-developed while being conveyed in a transfer direction comprising:

a plurality of elastic conductive wires and disposed in a direction perpendicular to said transfer direction and positioned at even intervals so as to come into contact with the surface of the conductive base of said material over a full width thereof during its travel in said transfer direction to attendantly provide a high density contact, said wires being reverse side conductors.

9. An electrode as claimed in claim 8, further comprising a fixed member, wherein said conductive wires are attached at one end thereof respectively to said fixed member, and are injected with electrons through embedded wires.

10. An electrode as claimed in claim 8, further comprising a fixed member, wherein said conductive wires are attached at one end thereof respectively to said fixed member, and conductive wires have curved portions on the other end thereof respectively.

11. An electrode for use in the electrophotographic development of a photosensitive material in the form of a sheet comprising a photosensitive layer containing a photoconductive substance coated on a base made of a flexible conductive sheet-like substance, said material being liquid-developed while being conveyed in a transfer direction, comprising:

a plurality of elastic conductive wires oriented in a direction transverse to said transfer direction and positioned in a manner to come into contact with the conductive base of said material during its travel in said transfer direction, wherein said conductive wires are connected to each other with a soft sheet.

12. An electrode as claimed in claim 11, wherein said soft sheet is made of synthetic resin.

13. An electrode for use in the electrophotographic development of an electrophotographic material in the form of a sheet comprising a photosensitive layer containing a photoconductive substance coated on a base made of a flexible conductive sheet-like substance, said material being liquid-developed while being conveyed in a transfer direction, comprising:

a fixed member;

at least conductive coil-like spring member supported at both ends thereof by said fixed member and operative to come into contact with the conductive base of the electrophotographic material as said material is being conveyed for development in the transfer direction, the coils of said spring member being oriented transverse to the transfer direction of said material.

14. An electrode as claimed in claim 13, wherein said conductive coil-like spring member is arranged in a manner to allow separate and independent movement of the coils thereof on said fixed member.

15. An electrode as claimed in claim 13, wherein said conductive coil-like spring member is covered with a soft sheet for connection.

16. An electrode as claimed in claim 13, wherein said conductive coil-like member is fixed with clasps on said fixed member at positions where the two members contact.

17. An electrode for use in the electrophotographic development of an electrophotographic material in the form of a sheet comprising a photosensitive layer containing a photoconductive substance coated on a base made of a flexible conductive sheet-like substance, said material being liquid-developed while being conveyed in a transfer direction, comprising:

a conductive fixed member;

a plurality of conductive thread-like members, each thread-like member being attached at one end to said fixed member and having a conductive bulb connected on a second end thereof, said fixed member being oriented to cause said bulbs to contact said conductive base surface of said electrophotographic material, as said material is being conveyed for development in the transfer direction, said plurality of thread-like member being oriented to permit said bulbs to contact substantially all of said material in a direction transverse to said transfer direction of said material.

18. An electrode as claimed in claim 17, wherein said conductive bulbs are made of at least one of metal and plastic.

19. An electrode for use in the electrophotographic development of an electrophotographic material in the form of a sheet comprising a photosensitive layer containing a photoconductive substance coated on a base made of a flexible and conductive sheet-like substance, said material being liquid-developed while being conveyed in a transfer direction, comprising:

a conductive brush member having conductive bristles, said brush member being oriented to have said bristles thereof come into contact with substantially an entire dimension of the base of said electrophotographic material in the direction perpendicular to said transfer direction.

20. An electrode as claimed in claim 19, wherein said electrophotographic material is conveyed with said photosensitive layer facing upward, and said conductor comprising a brush having bristles implanted thereon is oriented toward the surface of said base so that a DC electric field is generated between said electrode and said photosensitive layer.

21. An electrode as claimed in claim 19, wherein said brush member comprises bristles implanted on a rectangular fixed member.

22. An electrode as claimed in claim 19, wherein said brush member has bristles implanted on the surface of a rotary shaft.

23. An electrode for use in the electrophotographic development of an electrophotographic material in the form of a sheet comprising a photosensitive layer containing a photoconductive substance coated on a base of a flexible and conductive sheet-like substance, said material being liquid-developed while being conveyed in a transfer direction, comprising:

two fixed members, each having a longitudinal axis, and being oriented with their longitudinal axes in parallel, a conductive coil-like spring member suspended between said two fixed members in the form of a FIG. 8, said spring member being arranged to come into contact with the wonductive base of said electrophotographic material as said material is being conveyed for development in the transfer direction, the coils of said spring member being oriented transverse to said transfer direction.

24. An electrode as claimed in claim 23, wherein said coil-like spring member is fixed on said two fixed members with clasps at positions of contact thereof so as to prevent axial movement.

25. An electrode as claimed in claim 24, wherein said coil-like spring is fixed on said fixed members on terminals thereof.

26. An electrode for use in the electrophotographic development of an electrophotographic material in the form of a sheet comprising a photosensitive layer containing a photoconductive substance coated on a base made of a flexible and conductive sheet-like substance, said material being liquid-developed while being conveyed in a transfer direction, comprising:

conductive member means for injection electrons and being oriented in a direction transverse to said transfer direction of said material, said conductive member means comprising an elastic irregular surface, a portion of said surface being in contact with the base of said material.

27. An electrode as claimed in claim 26, wherein said conductive electron injection member comprises a plate-like fixed member and needle-like conductive members implanted on said plate-like fixed member.

28. An electrode as claimed in claim 27, wherein said conductive electron injection member is an embossed plate having elasticity.

29. An electrode for use in the electrophotographic development of an electrophotographic material in the form of a sheet comprising a photosensitive layer containing a photoconductive substance, said material being liquid-developed while being conveyed in a transfer direction, comprising:

a plurality of elastic conductive wires oriented transverse to the transfer direction of said material and in contact with the base of said material and a driving means for driving said conductive wires to provide sliding contact of said wire with said base for development of said material.

* * * * *